United States Patent [19]

Neumann et al.

[11] Patent Number: 5,004,101

[45] Date of Patent: Apr. 2, 1991

[54] BELTABLE PLASTIC CASING FOR ELECTRIC PLUG CONNECTORS

[75] Inventors: Andreas Neumann, Wuppertal; Michael Wiese, Remscheid, both of Fed. Rep. of Germany

[73] Assignee: Grote & Hartmann GmbH & Co. KG, Wuppertal, Fed. Rep. of Germany

[21] Appl. No.: 430,766

[22] Filed: Nov. 2, 1989

[30] Foreign Application Priority Data

Nov. 9, 1988 [DE] Fed. Rep. of Germany ... 8814029[U]

[51] Int. Cl.[5] ..... B65D 85/24; B65D 73/02

[52] U.S. Cl. ..... 206/343; 206/330; 206/820; 439/885

[58] Field of Search ..... 206/328, 330, 820, 338, 206/343; 439/885; 174/52.1

[56] References Cited

U.S. PATENT DOCUMENTS

| | | | |
|---|---|---|---|
| 3,431,548 | 3/1969 | Busler | 206/330 X |
| 3,550,856 | 12/1970 | Wise et al. | 206/330 X |
| 3,606,000 | 4/1971 | Wise | 206/330 |
| 3,666,090 | 5/1972 | Johnson et al. | 206/330 |
| 4,466,692 | 8/1984 | Sonoda | 206/330 X |
| 4,753,003 | 6/1988 | Gobeil | 439/885 X |
| 4,763,780 | 8/1988 | Zebley et al. | 206/330 |

FOREIGN PATENT DOCUMENTS

| | | |
|---|---|---|
| 3541610 | 5/1987 | Fed. Rep. of Germany . |
| 1514423 | 6/1978 | United Kingdom . |

*Primary Examiner*—Bryon P. Gehman

*Attorney, Agent, or Firm*—Goodman & Teitelbaum

[57] ABSTRACT

A casing of plastic provided with casing chambers for the reception of electric plug connectors, and also provided with rest arrangements connectable with rest arrangements of an adjacent casing to form a belt. A first rest arrangement is arranged on a first side wall and a second rest arrangement is arranged on the oppositely lying second side wall. The first rest arrangement includes at least one hook-shaped rest finger molded to the first side wall and projecting therefrom, being formed by a connecting strip and by a rest strip molded thereto and extending upward. On the second side wall there is arranged at least one outward-projecting lug member forming the second rest arrangement, which includes a connecting strip and a bow portion joined therewith. The bow portion is provided with a recess for receiving and retaining the rest strip of an associated similar casing therein to form the belt.

15 Claims, 1 Drawing Sheet

BELTABLE PLASTIC CASING FOR ELECTRIC PLUG CONNECTORS

Figure 1:
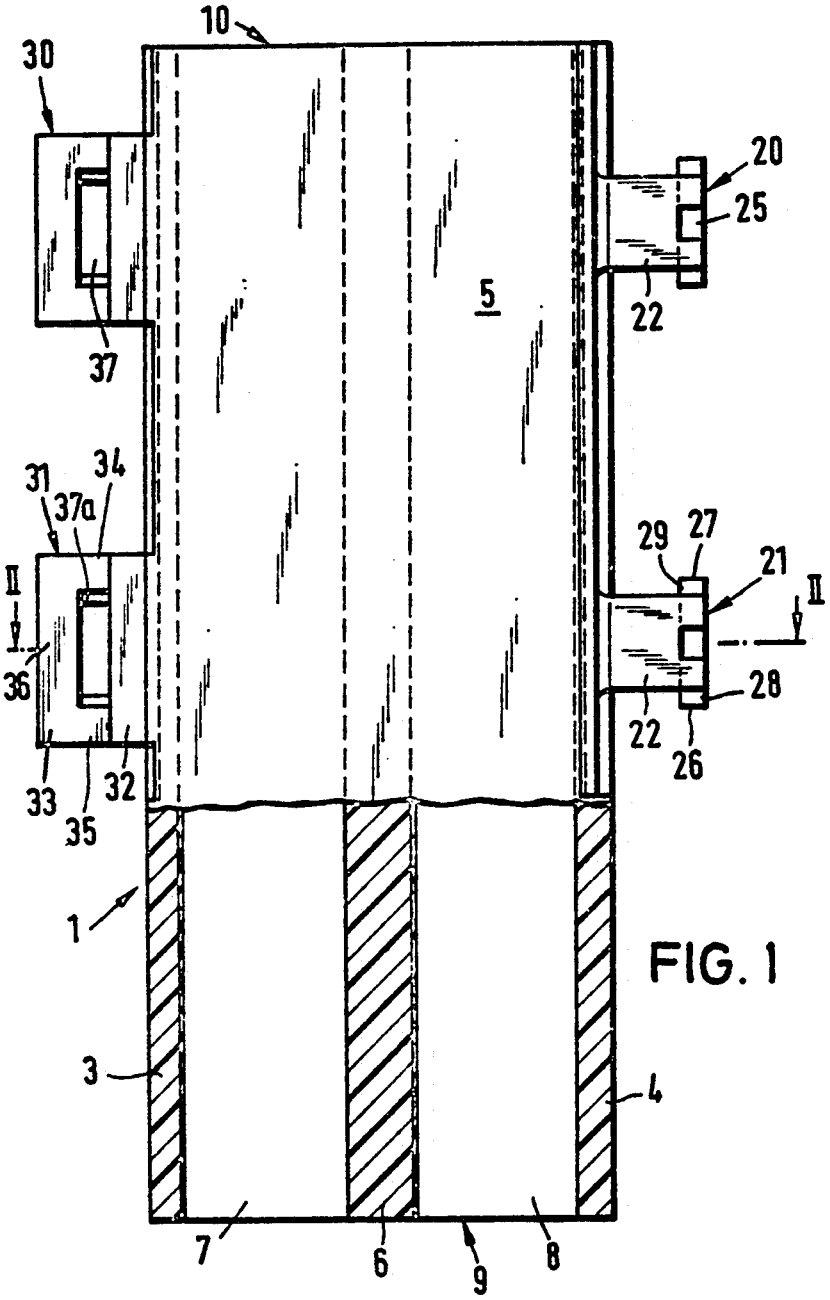

The present invention relates to a beltable plastic casing.

Such beltable plastic casings have become known with German unexamined patent specification No. DE-OS 35 41 610. The known beltable plastic casing is formed in such a way that it presents in each case one or more strips which are received by a recess in the adjacent casing. Although these known plastic casings can be used very satisfactorily, for their shaping there are required three shaping directions and therewith three shaping steps. Moreover there is the need to improve the technical properties of this known casing in respect to the strength of the belt connection.

Beltable casings of the type mentioned at the outset are used to receive electric contacts. The casings are joined with one another into a belt to make possible their machine processing.

Meeting these processing conditions, the casing must fulfill relatively different conditions. On the one hand, the casing must be formed in such a way that a flexible, windable belt results, which is windable already with a small radii of curvature. Further, the assembling of the individual casings should be possible to accomplish relatively simply. On the other hand, however, these casings must be very securely held together, since a tearing of the connection leads to a standstill of the machine and to a production down time until the belt band is again rethreaded.

Underlying the present invention, therefore, is the problem of providing casings of the type mentioned at the outset with belting arrangements which can be produced more simply and more economically and can be put together in a simple manner, the connection presenting a higher tensile strength.

This problem is solved according to the invention as set forth below, where preferable forms of execution of the invention are described.

With the invention there is created a beltable casing which can be produced in an especially simple manner. To this there contributes especially the fact that the number of shaping directions, which is essential for the material and production costs, has here been reduced. In the known belt band plastic casings three demolding directions are necessary in order to produce the casing with the recess. In the casing according to the invention only two shaping directions are required, so that the production is very much simpler.

Further, the formation according to the invention makes it possible to join the plastic casings with one another in a simple manner, i.e. to assemble them into belts by machine.

Further, the formation according to the invention makes it possible to carry out the joining of the individual casings with little expenditure of material.

Figure 2:
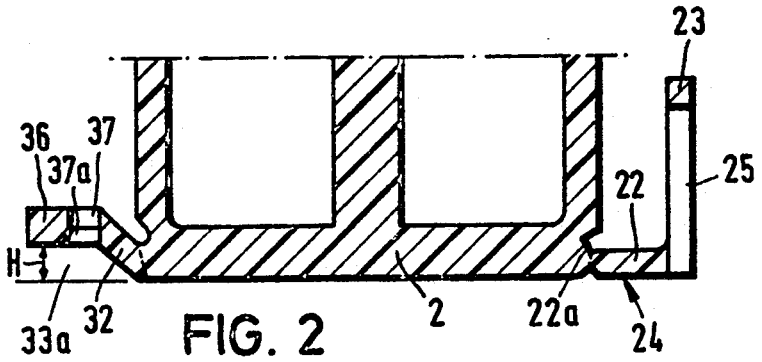
Figure 3:
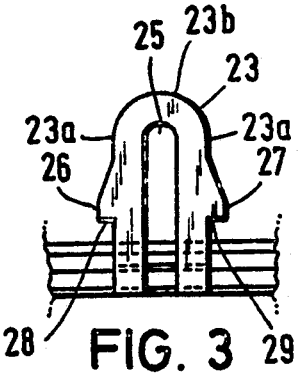

Further features of the invention are yielded from the following description of an example of execution in conjunction with the drawing. In this there is shown, in schematized representation:

FIG. 1: a view from underneath of the example of execution of the casing according to the invention;

FIG. 2: a cross section through the lower half of the casing according to FIG. 1 along the line II—II with viewing in arrow direction;

FIG. 3: a front view of a rest strip.

In FIGS. 1 to 3 there is represented a beltable casing 1 injection-molded of plastic.

The casing 1 has a bottom wall 2, side wall 3, to the left in respect to FIG. 1, a right side wall 4 and a cover wall 5. Parallel to the two side walls in the interior of the casing there is arranged a partition 6 by which there are formed two chambers 7 and 8 of equal size running parallel to the side walls. The chambers are open on the casing front side 9 and on the casing rear side 10, and intended for the reception of electric contact elements (not represented).

The first hook-shaped rest arrangements are molded on the right side wall 4 and project outward from these. They consist of two rest fingers 20, 21, which are formed by connecting strip 22 and by a rest strip 23 extending vertically upward from this connecting strip, and molded thereto. The lower surface 24 of the connecting strip 22 lies in the same plane as the lower surface of the bottom wall 2. The connecting strip is formed, further, with a rectangular cross section.

The rest strip 23 is provided with a longitudinally running recess 25 and presents two side edges 23*a* and an arcurate upper edge 23*b*. On the longitudinal edges 23*a* there are formed rest lugs 26, 27, which present downward-directed rest edges 28 29.

On the left side wall 3 of the casing there are arranged second rest arrangements 30, 31, projecting outward, which are formed complementary to the first rest arrangements.

The second lug-form rest arrangements consist in each case of a connecting strip 32 and of a bow 33 joined with it. The connecting strip 32 is sloped upward from the under-surface of the bottom wall 2 by, for example, about 45 degrees. The bow 33 connecting to this connecting strip is arranged horizontally or parallel to the bottom surface and consists of two U-shanks 34, 35 and of a U-bottom strip 36 running parallel to the left side wall. The two U-shanks 34, 35, and the U-bottom strip 36 enclose together with the connecting strip a rectangular recess 37. The bending-up of the connecting strip 32 yields an open space 33*a* under the bow 33 with a certain height "H". This height corresponds to the thickness of the connecting strip 22, so that a belt can be formed with flush bottom surfaces of the casing.

The construction of this casing permits an especially economical production: The casings are produced individually, in which process by reason of the favorable spatial form of the belt arrangements there are required only two demolding directions, namely in longitudinal direction, i.e. in the lengthwise direction of the contact chambers and in perpendicular direction thereto. Thereby the tool set-up and the production are very economical to carry out.

After the production, the individual casings are joined with one another preferably by machine. For this, the two rest strips 23, which are located on one side of the casing, are put through the recesses 37 of the bows 33 that are located on another casing, until the rest lugs 26, 27 spring over the crosspieces 34, 35. The zone of the rest strips 23 underneath the rest lugs is then seated without play in the recess 37 and the surface of the connecting strip 22 is borne lying on the under-surface of the bow 33, so that the casings are girded free of play on one another. Through a plurality of such casings a casing belt is formed.

This casing belt, by reason of the flexibility of the belt arrangements, can be wound into a coil. Despite this flexibility, the rest arrangements, however, present a high tensile strength, which is achieved by the formation in the plane of the bottom wall and by the cross section formation of the rest arrangements.

Furthermore, the formation of the rest arrangement assures a very accurate spacing of the individual casings present in the belt to one another, which substantially facilitates the processing by machine. To improve the flexibility of the belt at the connecting place of the connecting strip 22 there can be provided notches 22*a*, which can act in the manner of a joint. They facilitate, furthermore, the threading into the recesses 37 and the taking apart of the equipped casings.

With the invention, accordingly, it is possible with two shaping directions to make the belt arrangements. In the known belt arrangements it was necessary to absorb tension forces arising from rest lugs. The present invention provides, in contrast, that the tensile forces are absorbed in each case by the connecting strip, so that considerably stronger tensile forces can act without the belt arrangement being torn apart. The new belt arrangement is easily pluggable, but derestable with difficulty. There the recesses 25 provide for a springy yielding of the remaining straps of the rest crosspiece, U-shaped in front view. In the belting there can serve casing outer wall surfaces as guide surfaces or engagement surfaces, because the adjacent casing is threaded from above. The lateral pushing together in the known belt arrangements is extremely difficult. Accordingly, it has been accomplished with simple means to make a very effective belt arrangement.

Expediently, the inner surfaces of the U-shanks 34, 35 facing the recess 37 present in each case an entry bevel 37*a* facing the inner space of the recess 37 from underneath, which bevel interacts with the arcuate edge 23*b* of the rest crosspiece 23 in such a way that the threading of the rest crosspiece 23 into the recess 37 can occur without problems. The width of the recess 37 corresponds to the width of the rest crosspiece 23, measured in each case from one edge 23*a* to the other edge 23*a*. Although projecting rest lugs 26, 27 are molded to the edges 23*a*, the rest crosspiece 23 can be inserted without great plugging force through the recess 37, because the U-shaped spatial form of the rest crosspiece 23 provided with the recess 25 makes possible a springing of the U-shanks 34, 35 of the rest crosspiece 23 toward the interior of the recess 25. After the snapping in place of the rest crosspiece 23 there is yielded the already mentioned play-free seating of the rest crosspiece in the recess 37, because also the thickness of the rest crosspiece 23 is attuned to the depth of the recess 37.

We claim:

1. An individual casing comprising:

said casing being fabricated from plastic;

said casing being provided with casing chambers for reception of electric plug connectors;

said casing having a bottom wall and first and second side walls connected to said bottom wall, said first and second side walls being parallel to each other, said first and second side walls being perpendicular to said bottom wall;

inner surfaces of said bottom wall and said first and second side walls providing walls for said casing chambers;

a cover wall disposed on said first and second side walls opposite said bottom wall to provide a top wall for said casing chambers;

said first and second side walls having snap-together engagement means to securely connect said casing to other casings in a side-by-side arrangement to form a casing belt which can be wound into a coil;

said snap-together engagement means including a first rest arrangement on said first side wall and a second rest arrangement on said second side wall;

said first arrangement including at least one hook-shaped rest finger, said rest finger including a first connecting strip molded to an outer surface of said first side wall and a rest strip molded to said first connecting strip, said first connecting strip projecting perpendicularly outward from said outer surface of said first side wall, said rest strip extending vertically upward from said first connecting strip in a direction toward said cover wall, said rest strip being disposed parallel to said first side wall;

a vertical length of said first side wall being disposed between said bottom wall and said cover wall, said vertical length being longer than said rest strip;

said second rest arrangement including at least one lug member, said lug member including a second connecting strip molded to an outer surface of said second side wall and a bow portion molded to said second connecting strip; and said bow portion being provided with recess means for receiving a rest strip of a hook-shaped rest finger of a first adjacent casing in a snap-together relationship to securely connect said individual casing and said first adjacent casing together;

and said rest strip of said hook-shaped rest finger of said individual casing can be received in a bow portion of a lug member of a second adjacent casing in a snap-together relationship to securely connect said individual casing and said second adjacent casing together whereby said second adjacent casing, said individual casing and said first adjacent casing are disposed in a side-by-side arrangement to form a casing belt.

2. An individual casing according to claim 1, wherein a lower surface of said first connecting strip lies in a plane, and an under-surface of said bottom wall also lies in said plane.

3. An individual casing according to claim 1, wherein said first connecting strip has a rectangular cross section.

4. An individual casing according to claim 1, wherein said rest strip of said rest finger is provided with a centrally disposed recess extending vertically upward in a longitudinal direction of said rest strip.

5. An individual casing according to claim 4, wherein said rest strip includes outside vertical side edges on opposite sides of said recess and an arcuate upper edge connected to said side edges to provide a U-shaped construction.

6. An individual casing according to claim 5, wherein a rest lug is molded on each of said side edges of said rest strip, each said rest lug including a rest edge facing downward in a direction toward said first connecting strip.

7. An individual casing according to claim 1, wherein said second connecting strip of said lug member extends outward from said bottom wall in an oblique upward direction to said bow portion, said bow portion extending from said second connecting strip in a horizontal direction parallel to an under-surface of said bottom wall.

8. An individual casing according to claim 7, wherein said bow portion is off-set by said second connecting strip a predetermined upward distance from said under-surface of said bottom wall, said predetermined upward distance corresponding to a thickness of said first connecting strip of said rest finger.

9. An individual casing according to claim 7, wherein said bow portion is provided with a rectangular recess defining said recess means, said bow portion including two shanks on opposite sides of said recess and a bottom strip connected to said two shanks to provide a U-shaped construction, said bottom strip being parallel to said second side wall, said second connecting strip being disposed opposite said bottom strip so that said recess is bounded by said bottom strip, said two shanks and said second connecting strip.

10. An individual casing according to claim 9, wherein said rest strip of said rest finger is provided with rest lugs, each of said rest lugs including a rest edge facing downward in a direction toward said first connecting strip.

11. An individual casing according to claim 10, wherein said rest edge is positioned at a predetermined height above said under-surface of said bottom wall, and an upper surface of each of said two shanks of said bow portion also being positioned at said predetermined height above said under-surface of said bottom wall.

12. An individual casing according to claim 11, wherein an upper surface of said first connecting strip is positioned at a second predetermined height above said under-surface of said bottom wall, and an under-surface of said bow portion also being positioned at said second predetermined height above said under-surface of said bottom wall.

13. An individual casing according to claim 12, wherein a width of said rest strip corresponds to a first length of said recess, and a thickness of said rest strip corresponds to a second length of said recess, said first length being longer than said second length.

14. An individual casing according to claim 9, wherein surfaces of said two shanks facing an interior of said recess are each provided with an introduction bevel extending from an under-surface of each of said two shanks to said interior of said recess.

15. An individual casing according to claim 1, wherein notches are provided at a connecting place between said first connecting strip and said first side wall to provide a flexible joint so that said rest finger is flexible relative to said first side wall to facilitate the winding of the casing belt into a coil.

* * * * *